United States Patent [19]

Wells

[11] Patent Number: 4,913,297

[45] Date of Patent: Apr. 3, 1990

[54] DISPLAY UNIT

[75] Inventor: Paul S. Wells, Mt. Vernon, Wash.

[73] Assignee: Tyee Trading Corporation, Mount Vernon, Wash.

[21] Appl. No.: 242,781

[22] Filed: Sep. 9, 1988

[51] Int. Cl.[4] ..... A47F 5/00

[52] U.S. Cl. ..... 211/96; 211/106; 211/169; 248/224.3

[58] Field of Search ..... 211/96, 106, 169, 168; 248/223.4, 224.3

[56] References Cited

U.S. PATENT DOCUMENTS

| | | | |
|---|---|---|---|
| 1,366,526 | 1/1921 | Deragon | 211/96 |
| 2,805,799 | 9/1957 | Caverley | 211/96 |
| 3,333,711 | 8/1967 | Helmer et al. | 211/96 |
| 3,337,059 | 8/1967 | Le Hoy | 211/40 X |
| 3,608,740 | 9/1971 | Bowman, Jr. | 211/96 |
| 3,759,396 | 9/1973 | Best et al. | 211/169 X |
| 3,915,189 | 10/1975 | Holbrook et al. | 248/223.4 X |
| 3,924,749 | 12/1975 | Weston | 211/169 X |
| 3,960,273 | 6/1976 | Weston | 211/40 X |
| 3,978,612 | 9/1976 | Young | 211/96 X |
| 4,159,773 | 7/1979 | Losenno | 248/224.3 X |
| 4,721,212 | 1/1988 | Lowe | 211/96 X |

FOREIGN PATENT DOCUMENTS

| | | | |
|---|---|---|---|
| 1279485 | 11/1961 | France | 211/169 |

*Primary Examiner*—Robert W. Gibson, Jr.
*Attorney, Agent, or Firm*—Christensen, O'Connor, Johnson & Kindness

[57] ABSTRACT

An apparatus for displaying merchandise adjacent a display structure is disclosed. The apparatus includes a frame and an attachment mechanism for securing the frame to the display structure so that the frame is rotatable about a vertical axis, thereby providing access to the display structure. The frame includes a pair of non-parallel panels having a shared edge. The interior panel surfaces preferably form an interior angle between 90 and 180 degrees. The interior surfaces are suitable for displaying merchandise adjacent thereto. The attachment mechanism includes first and second brackets for connecting the frame to the display structure, a downward hook for securing the second bracket to the frame, and an adjustment mechanism for securing the first bracket to the frame at a plurality of positions, to thereby permit adjustment of the spacing between the first and second brackets. The adjustment mechanism includes a loop formed of a portion of the shared edge and an outer edge. The first bracket includes a shelf plate for attaching the bracket to a portion of the display structure, a friction clip extending from the shelf plate, and an insert plate positionable at a plurality of positions along the length of the outer edge. The insert plate is slidably insertable into the friction clip such that a section of the outer edge is captured between the insert plate and the friction clip thereby securing the frame to the first bracket. The second bracket includes a shelf plate for attaching the bracket to a portion of the display structure, and a support clip into which the downward hook is positionable. The second bracket supports the frame relative to the display structure. The extent of the adjustability in the spacing between the first and second bracket corresponds to the length of the outer edge.

5 Claims, 2 Drawing Sheets

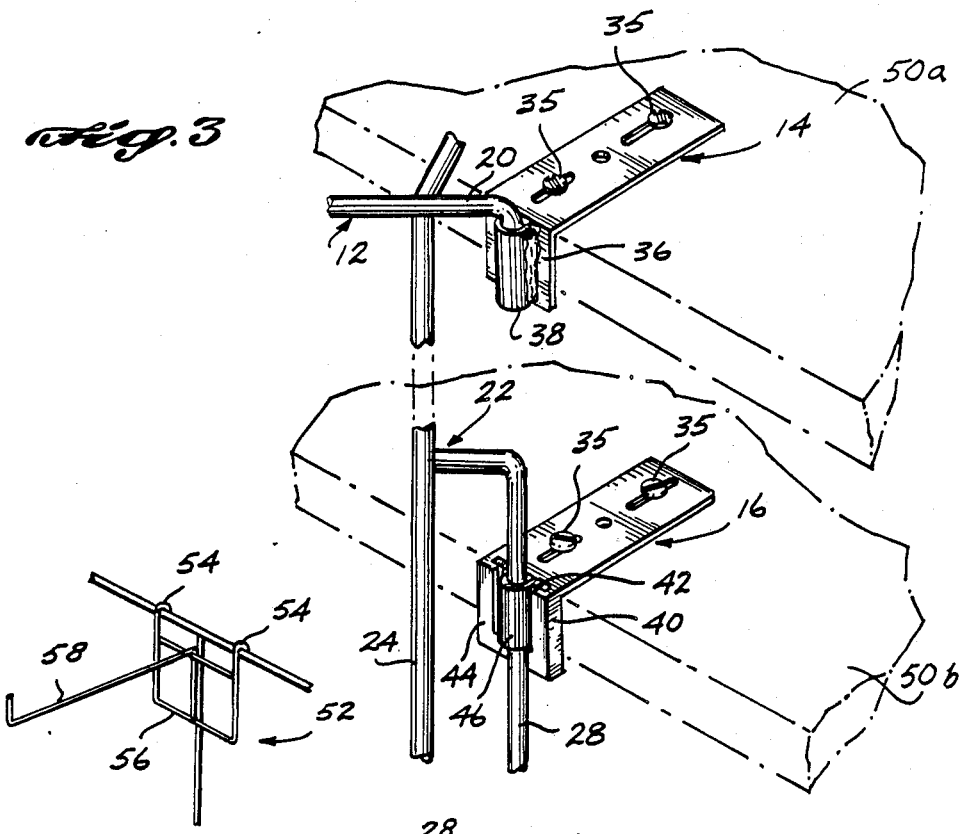
Fig. 3
Fig. 4.
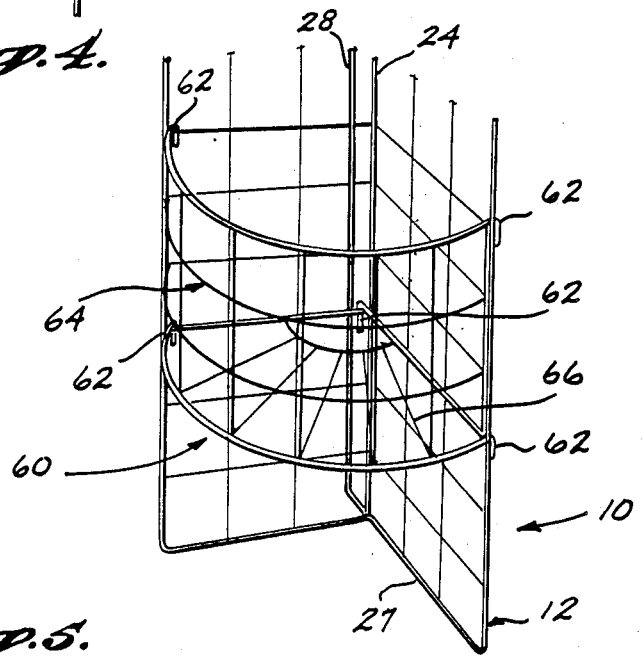
Fig. 5.

DISPLAY UNIT

FIELD OF THE INVENTION

The present invention relates to a device for displaying merchandise. More particularly, the present invention relates to apparatus that is attachable to a display structure so that additional display area is provided in front of the display structure and access to the display structure is not blocked.

BACKGROUND OF THE INVENTION

Devices and methods for displaying merchandise are numerous. Two major concerns in the merchandise display field are the need for efficient use of space and the need for attractive, logical, and accessible merchandise arrangements. Display problems may arise when relatively permanent shelving units are used to display and store merchandise and new or promotional merchandise is to be presented. When new or promotional merchandise that is related to the items generally found on the shelves is to be displayed, it is desirable to arrange the new merchandise adjacent the related items. For example, if toothpaste is arranged on a permanent shelf, it is desirable to display new toothbrushes adjacent the toothpaste shelf. This display technique is often referred to as cross-merchandising. Because of the temporary nature of cross-merchandising, it is undesirable to rearrange the permanent display to accommodate the new, temporary merchandise.

Two types of display units have generally been used to accommodate cross-merchandising needs. One type of display unit is a free-standing display rack that is supported by wheels or a stand and provides a variety of hooks or hangers to which merchandise is attached. These display racks generally take up a substantial amount of room since they must be large enough to be stable standing alone. These display racks tend to block access to the shelves that they are positioned next to and/or block passage through aisleways. Another type of display unit provides a series of vertically aligned hooks or hangers upon which merchandise is hung. These display units are generally hung from shelves in a manner that prevents them from blocking access to the adjacent shelves, i.e., they are hung in front of the vertical space between two adjacent shelving units. These hanging types of display units generally have only a small merchandise capacity.

The present invention provides an apparatus that overcomes the drawbacks of display units as discussed above as well as other problems of the prior art.

SUMMARY OF THE INVENTION

The present invention provides an apparatus for displaying merchandise adjacent a display structure so that access to the display structure is not hindered by the apparatus. The apparatus includes a frame and an attachment mechanism for attaching the frame to the display structure. The frame includes a pair of nonparallel panels having a shared edge. Merchandise or other display mechanisms are securable to the interior panel surfaces. The attachment mechanism attaches the frame to the display structure so that the frame is rotatable about a vertical axis adjacent the shared panel edge. Thus, the apparatus is rotatable to thereby provide access to the region of the display structure located behind the apparatus.

In accordance with other aspects of the present invention, the apparatus is mountable upon a display structure that includes a pair of vertically spaced shelves. The attachment mechanism includes first and second brackets for connecting the frame to the respective shelves and an adjustment mechanism for securing one of the brackets to the frame at a variety of positions to thereby permit adjustment of the spacing between the brackets to accommodate variable spacing between the shelves.

In accordance with further aspects of the present invention, the adjustment mechanism includes a loop formed of a portion of the shared edge and an outer edge. The outer edge is situated on the side of the frame opposite the panel interior surfaces. The first bracket includes a shelf plate for attaching the bracket to a shelf, a friction clip extending from the shelf plate, and an insert plate positionable at a variety of positions along the length of the outer edge. Once the shelf plate is attached to a shelf, the insert plate is slidably inserted into the friction clip so that a section of the outer edge is captured between the insert plate and the friction clip. In this manner the frame is secured to the first bracket. The extent of the adjustability in the spacing between the brackets corresponds generally to the length of the outer edge.

In accordance with additional aspects of the present invention, the attachment mechanism includes a downward hook extending from the top of the shared edge. The second bracket includes a shelf plate for attaching the bracket to a shelf, and a support clip extending from the shelf plate for receiving the hook. Once the shelf plate is attached to the shelf, the hook is positioned within the support clip to thereby secure the frame relative to the shelf.

In accordance with still further aspects of the present invention, the interior angle formed by the panels, i.e., between the interior surfaces, is less than 180 degrees and greater than or equal to 90 degrees. When the apparatus is rotated in from the shelves, the panel configuration ensures that access to the shelves will not be blocked.

BRIEF DESCRIPTION OF THE DRAWINGS

The foregoing objects and many other advantages of the invention will become more readily appreciated as the same becomes better understood by reference to the following detailed description, when taken in conjunction with the accompanying drawings, wherein:

FIG. 3 is an isometric view of the attachment mechanism connecting a frame and display structure in accordance with the present invention;

FIG. 4 is an isometric view of a hook suitable for use with the display unit of the present invention; and FIG. 5 is an isometric view of a basket suitable for use with the display unit of the present invention.

DETAILED DESCRIPTION OF THE INVENTION

Figure 1:
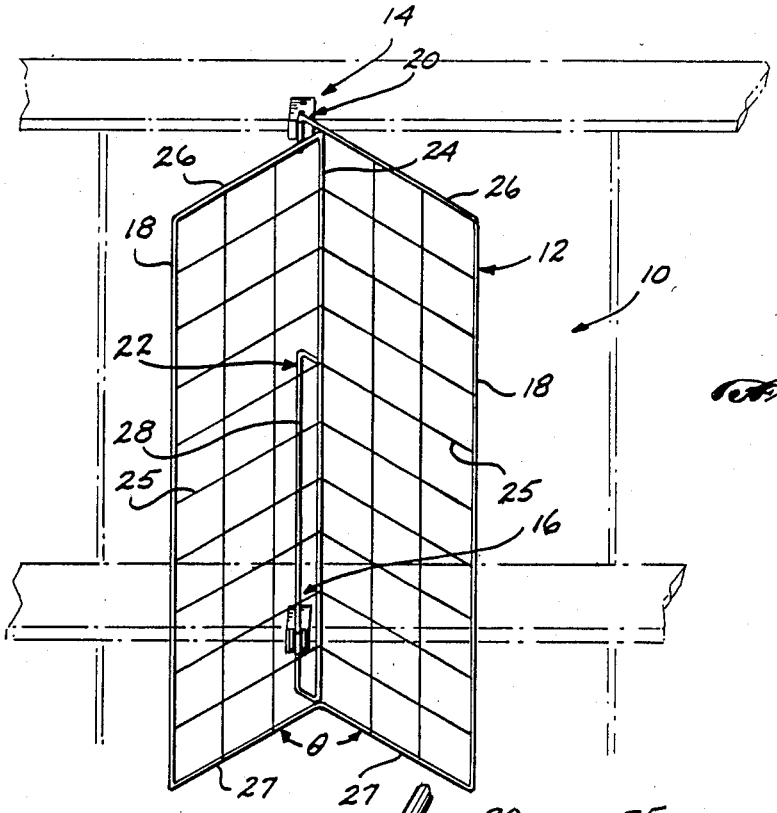
FIG. 1 is an isometric view of the display unit of the present invention.

With reference to FIG. 1, the display unit 10 of the present invention includes frame 12, upper bracket 14, and lower bracket 16.

Frame 12 is preferably made up of a single length of material, such as metal tubing, shaped to form two panels 18, hook 20, and loop 22. Panels 18 are nonparallel panels having shared edge 24, interior panel surfaces 25, top edges 26, and bottom edges 27. The interior angle $\theta$ formed by the panels is preferably less than 180 degrees and greater than or equal to 90 degrees. The angle between the panels is less than 180 degrees so that when the panels are mounted in front of display shelves, as discussed below, the display shelves are accessible. The angle between the panels is greater or equal to 90 degrees so that items displayed along interior panel surfaces 25 are accessible. Preferably, interior panel surfaces 25 are formed of wire grid, to which conventional display hooks or hangers are attachable. The wire grids additionally allow the shelves behind the respective panels to be partially viewable even when a panel is positioned directly in front of a shelf.

Hook 20 and loop 22 each extend from near shared edge 24. Hook 20 extends perpendicularly from shared edge 24 near top edges 26 and then at a right angle, thereby forming a downward hook. Loop 22 preferably forms a closed loop with shared edge 24 and outer edge 28. Outer edge 28 runs parallel to a portion of shared edge 24 and is coaxial with the vertical portion of hook 20. Loop 22 is formed by connecting outer edge 28 at one or both ends of the outer edge to shared edge 24. The loop is formed such that the position of outer edge 28 is relatively rigid in relation to panels 18. Loop 22 preferably begins near bottom edge 27. The length of outer edge 28 determines the spacing characteristics of the display structures to which the display unit is attachable. This aspect of the present invention will be discussed below.

Figure 2:
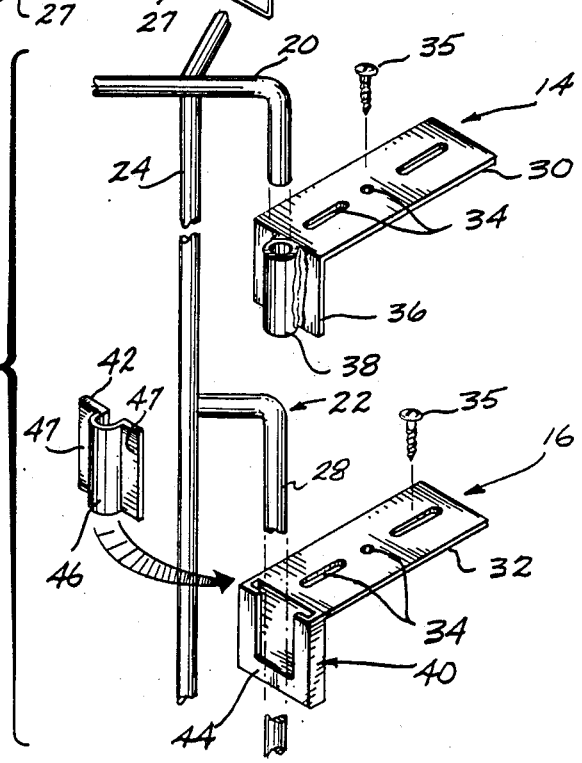
FIG. 2 is an exploded isometric view of the attachment mechanism of the present invention.

With reference to FIG. 2, upper bracket 14 and lower bracket 16 each includes a shelf plate 30 and 32, respectively, which are attachable to a display structure, such as a pair of shelves. Each shelf plate includes one or more apertures 34 suitable for receiving bolts 35 or other devices for securing the plates to the shelves. Upper bracket 14 also includes support clip 36 extending perpendicularly from one edge of shelf plate 30. Support clip 36 includes sleeve 38 that extends along the support clip perpendicular to shelf plate 30. Sleeve 38 is suitable for receiving hook 20 to thereby support frame 12 in a relatively upright manner. Sleeve 38 is sized so that hook 20 is rotatable within the sleeve.

Lower bracket 16 includes friction clip 40 and insert plate 42. Friction clip 40 extends perpendicularly from one edge of shelf plate 32. Friction clip 40 includes U-frame 44 that has an open upper edge. Insert plate 42 includes sleeve 46, and a pair of outwardly extending flanges 47. The flanges are sized so as to be slidably insertable into U-frame 44. Insert plate 42 is insertable into U-frame 44 so that sleeve 46 is supported in a position perpendicular to shelf plate 32. Insert plate 42 slides into U-frame 44 through the open upper edge and is supported by the side edges and the lower portion of the frame. Sleeve 46 is sized so as to capture a section of outer edge 28 of loop 22 in a rotatable manner between insert plate 42 and friction clip 40 when the insert plate is positioned about outer edge 28 and then inserted into the friction clip.

With reference to FIG. 3, in order to mount display unit 10 adjacent a pair of shelves 50(*a*) and 50(*b*), upper bracket 14 and lower bracket 16 are vertically aligned on the shelves so that sleeves 38 and 46 are coaxial. The brackets are secured to the shelves by bolt assemblies 35. The brackets are mounted so that support clip 36 and friction clip 40 are flush against the front edge of the respective shelf. The distance between the brackets is less than or equal to the height of frame 12 measured along shared edge 24, and is greater than or equal to the distance between hook 20 and the top of loop 22. Once the brackets are securely mounted, frame 12 is connected to upper bracket 14 by inserting hook 20 into sleeve 38 of support clip 36. Insert plate 42 is then positioned above lower bracket 16, and outer edge 28 of loop 22 is aligned within sleeve 46. Insert plate 42 is then slid downwardly into U-frame 44 thereby capturing the loop section between insert plate 42 and friction clip 40. In this manner, frame 12 is supported in a relatively upright position adjacent shelf 50(*a*), and is further secured to shelf 50(*b*) by the securing of loop 22 to bracket 16. The frame is rotatable about the hook and outer edge to allow access to shelves 50(*a*) and 50(*b*).

The distance between upper bracket 14 and lower bracket 16 is adjustable, since lower bracket 16 is attachable to outer edge 28 of loop 22 at a variety of positions along the length of the loop. This allows display unit 10 to be attachable to shelves that are variably spaced. For example, one preferred frame is six feet high with a one-foot-long loop. Thus, the display unit is attachable to a pair of shelves spaced between five and six feet.

The use of display unit 10 allows cross-merchandising or temporary displays to be effective without blocking access to shelves 50 behind the unit. Since display unit 10 is rotatable about hook 20 and outer edge 28 of loop 22, the entire unit is positionable by the consumer so that the shelves on one side or the other of the display unit are accessible by rotating the frame 12 about the brackets.

With reference to FIGS. 4 and 5, a variety of hangers and baskets are attachable to panels 18. Merchandise may be displayed from the hangers and/or in the baskets, as well as hung directly off of the panels. For example, hanger 52 in FIG. 4 has downward hooks 54 and lower brace 56. The hooks attach the hanger to the panel grid. The brace is horizontal and supports the hanger in a relatively rigid position by resting against one of the vertical grids in the panel surface. Merchandise is then hung from extension 58 of hanger 52 which projects perpendicularly from the inner panel surface when the hanger is positioned. As another example, basket 60 in FIG. 5 includes downward hooks 62, front panel 64 and bottom panel 66. The angle forming the arc of the front panel is equivalent to the interior angle $\theta$ formed by panels 18. The basket is hung by hooks 62 from the grids of panels 18. Basket 60 forms an open-topped basket in conjunction with panels 18. Merchandise is placed in the basket and is easily accessible.

While preferred embodiments of the invention have been illustrated and described, it will be appreciated that various changes can be made therein without departing from the spirit and scope of the invention. For example, by extending loop 22 from bottom edge 27 to top edge 26 of the frame, two brackets with friction clips and insert plates are used to attach outer edge 28 to the display structure. The upper portion of loop 22 would support the frame in a bracket in an upright position in the same manner that hook 22 does. Additionally, a variety of shelf attaching devices are suitable for securing the frame relative to the shelf in a rotatable manner. Finally, the interior surfaces 25 of panels 18 may be made up of a variety of materials and configurations such as cork board, small shelves, etc.

What is claimed is:

1. An apparatus for displaying merchandise adjacent a pair of vertically spaced shelves, said apparatus comprising:

(a) a frame including:

a pair of nonparallel panels, said panels having a shared edge and interior panel surfaces, said interior panel surfaces forming an interior angle of less than 180 degrees, said interior surfaces including means for displaying merchandise adjacent said surfaces, and (b) attachment means for securing said frame to a pair of vertically spaced shelves such that said frame is rotatable, relative to said shelves, about a vertical axis adjacent the shared edge to thereby allow access to said shelves, said attachment means including:

(i) first and second bracket means for connecting said frame to the outer edges of said shelves, and (ii) adjustment means for securing one of said bracket means to said frame at one of a plurality of continuous positions along said frame to thereby permit adjustment of the spacing between said bracket means.

2. An apparatus as claimed in claim 1, wherein said adjustment means includes a loop formed of a portion of said shared edge and an outer edge, and wherein said first bracket means includes a shelf plate for attaching said bracket means to a shelf, a friction clip extending from said shelf plate, and an insert plate positionable at a plurality of positions along the length of said outer edge and slidably insertable into said friction clip such that a section of said outer edge is captured between said insert plate and said friction clip thereby securing said frame to said first bracket means, whereby the extent of the adjustability in the spacing between said first and second bracket means corresponds to the length of said outer edge.

3. An apparatus as claimed in claim 1, wherein said attachment means further includes a downward hook extending from the top of said shared edge, and said second bracket means includes a shelf plate for attaching said bracket means to a shelf, and a support clip extending from said shelf plate for receiving said hook and thereby securing said frame relative to the shelf.

4. An apparatus as claimed in claim 1, wherein said angle formed by said panels is approximately equal to 90 degrees.

5. An apparatus for displaying merchandise adjacent a display structure, said apparatus comprising:

a frame including a pair of nonparallel panels, said panels having a shared edge and interior panel surfaces, said interior panel surfaces forming an interior angle between 90 and 180 degrees, said interior surfaces including means for displaying merchandise adjacent said surfaces; and, attachment means for securing said frame to the display structure such that said frame is rotatable about a vertical axis adjacent said shared edge to thereby allow access to the display structure, said attachment means including first and second bracket means for connecting said frame to the display structure, a downward hook for securing said second bracket means to said frame, and adjustment means for securing said first bracket means to said frame at a plurality of positions to thereby permit adjustment of the spacing between said bracket means, said adjustment means including a loop formed of a portion of said shared edge and an outer edge, said loop being generally spaced apart from said hook, said first bracket means including a shelf plate for attaching said bracket means to a portion of the display structure, a friction clip extending from said shelf plate, and an insert plate positionable at a plurality of positions along the length of said outer edge and slidably insertable into said friction clip such that a section of said outer edge is captured between said insert plate and said friction clip thereby securing said frame to said first bracket means, and said second bracket means includes a shelf plate for attaching said bracket means to the display structure, and a support clip extending from said shelf plate for receiving said hook and thereby securing said frame relative to the display structure, whereby the extent of the adjustability in the spacing between said first and second bracket means corresponds to the length of said outer edge.

* * * * *